United States Patent [19]

Robert

[11] Patent Number: 4,609,300

[45] Date of Patent: Sep. 2, 1986

[54] ADJUSTABLE WIPER FOR FLUID PRODUCT

[75] Inventor: Jean-Edouard Robert, Paris, France

[73] Assignee: Snap Duroc, Creuzier-le-Vieux, France

[21] Appl. No.: 634,754

[22] Filed: Jul. 26, 1984

[51] Int. Cl.[4] ..... A45D 40/00

[52] U.S. Cl. ..... 401/122; 132/88.7; 251/9; 251/10

[58] Field of Search ..... 401/121, 122; 132/88.5, 132/88.7; 251/9, 10

[56] References Cited

U.S. PATENT DOCUMENTS

| | | | |
|---|---|---|---|
| 492,580 | 2/1893 | Hadley | 251/9 X |
| 1,689,889 | 10/1928 | Nunes | 251/10 |
| 3,497,175 | 2/1970 | Koland | 251/9 |
| 3,612,474 | 10/1971 | Strohl, Jr. | 251/9 |
| 4,241,743 | 12/1980 | Schnabel et al. | 401/122 X |
| 4,332,494 | 6/1982 | Kingsford | 401/5 |

FOREIGN PATENT DOCUMENTS

| | | | |
|---|---|---|---|
| 0002301 | 6/1979 | European Pat. Off. . | |
| 765719 | 6/1934 | France | 401/122 |
| 1039833 | 10/1953 | France | 251/10 |
| 2515941 | 5/1983 | France . | |
| 8178 | 6/1899 | Norway | 401/122 |

*Primary Examiner*—Steven A. Bratlie

*Attorney, Agent, or Firm*—Christel, Bean & Linihan

[57] ABSTRACT

The present invention relates to an adjustable applicator for fluid product comprising a reservoir for the fluid product to be applied, a stopper carrying application means which are immersed in the fluid product in the reservoir (when the stopper is in place) and a wiping arrangement placed next to the opening of the reservoir, comprising a conduit having a variable transverse section for regulating the amount of product remaining on the applications means when it is withdrawn through the conduit.

According to the invention, in order to vary the section of the conduit, there is provided a wiper of resilient material, means for lateral adjustment of the wiper, which are movable about a fixed articulation point in order rigidly to restrict the wiper in a plane perpendicular to its longitudinal axis as well as means to activate the said means for lateral adjustment.

Use is particularly to the manufacture of make-up articles, and more particularly to mascara applicators.

5 Claims, 13 Drawing Figures

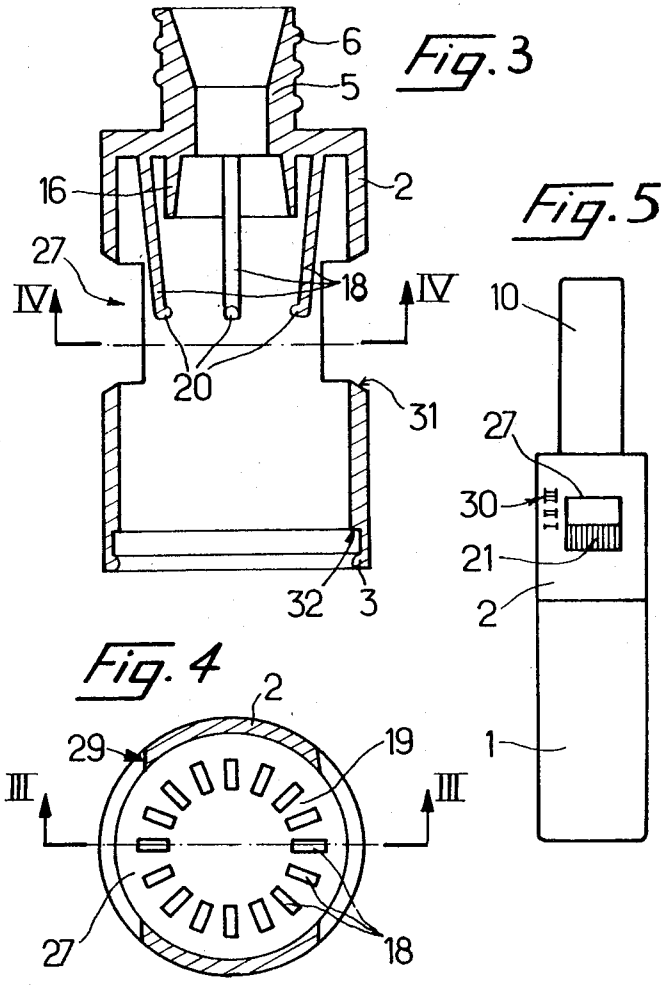
Fig. 3
Fig. 5
Fig. 4
IV
IV
III
III
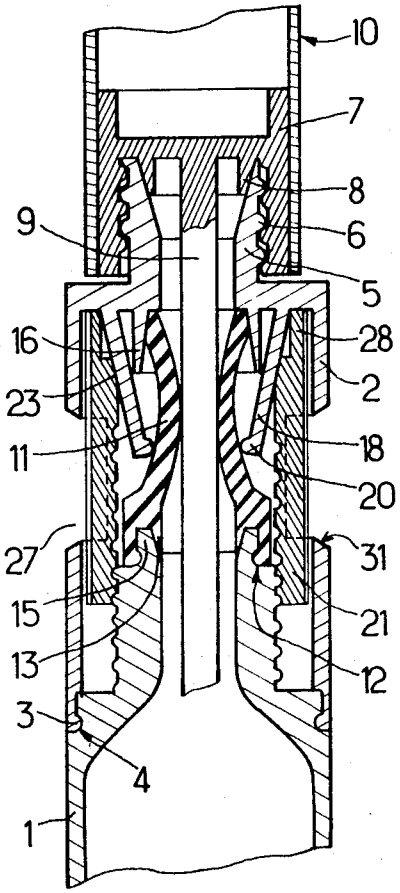
Fig. 2
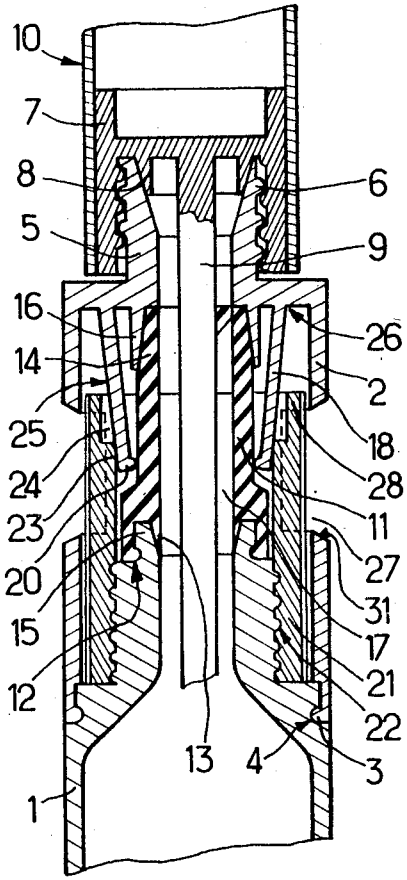
Fig. 1

IX
VIII
XI

ADJUSTABLE WIPER FOR FLUID PRODUCT

The present invention relates to an adjustable applicator for fluid product. An applicator for fluid product generally comprises a reservoir containing the fluid to be applied as well as a stopper provided with application means such as a brush, paintbrush, pad, sponge etc. This type of applicator relates principally to make-up articles, for the application of varnish to nails, of liquid eye-shadow, of mascara for eyelashes etc.

One of the problems, which this kind of applicator has, is the controlling of the amount of product applied. This amount depends in fact on the amount of product deposited on the brush or equivalent. In the case of mascara applicators, there are already in the prior art applicators provided with adjustable wiping means, which permit regulation of the amount of mascara to be applied as a function of the nature and thickness of the eyelashes of the user as well as according to their choice. European Patent Specification No: 0002301, which relates to an applicator consisting of a container for the mascara, and a brush mounted on its stopper, discloses a certain number of wiping arrangements whereby the brush, as it is withdrawn from the bottle, passes through a variable passage section so that there is retained in the bottle the superfluous mascara.

Several of these arrangements act on the brush by the intermediary of rigid parts such as lamella and orifices. The inconvenience of these arrangements is that they damage the brush, by the repeated passings of it over the rigid parts. This patent specification also discloses systems less aggressive for the brush, such as a sleeve deformable by longitudinal pressure or by torsion. However, these latter do not permit the ensuring of a positive adjustment on the brush. But, the mascara, which can have a variable fluidity, may be controlled to a certain extent in all cases. In the sleeve systems described in the patent specification cited above, the reduced section of sleeve effecting the wiping of the brush may be deformed by it and thus no longer play its role.

These problems are overcome according to the invention by the association with a resilient wiping element, which is in direct contact with the application arrangement, such as a brush, with rigid means of compression for this resilient element such that positive adjustment is assured.

According to the present invention there is provided an adjustable applicator for fluid product comprising a reservoir for the fluid product;

a stopper carrying application means which is immersed in the fluid product when the reservoir is closed by the stopper;

wiping means adjacent the reservoir mouth, the wiping means comprising a conduit having a variable transverse section, such that the amount of fluid product remaining on the application means when it is withdrawn through the conduit is regulated, the conduit being of resilient material; .

means for lateral adjustment of the said wiping means, which adjustment means are movable about a fixed articulation such as firmly to restrict the wiping means in a plane perpendicular to its longitudinal axis; and means for activating the said means of lateral adjustment.

The invention will be better described with the aid of the embodiments which follow and of the accompanying drawings relating thereto. In the drawings:

FIG. 1 is a sectional view through a mascara applicator according to the invention, in the position of minimum wiping dry.

FIG. 2 is a sectional view through this applicator, in the position of maximum wiping dry.

FIG. 3 is a sectional view through the cylindrical member (2) of FIGS. 1 and 2.

FIG. 4 is a view of the cylindrical member (2) along the line IV—IV of FIG. 3.

FIG. 5 is a general view of the applicator.

Figures 6, 7, 8, 9, 10, 11:
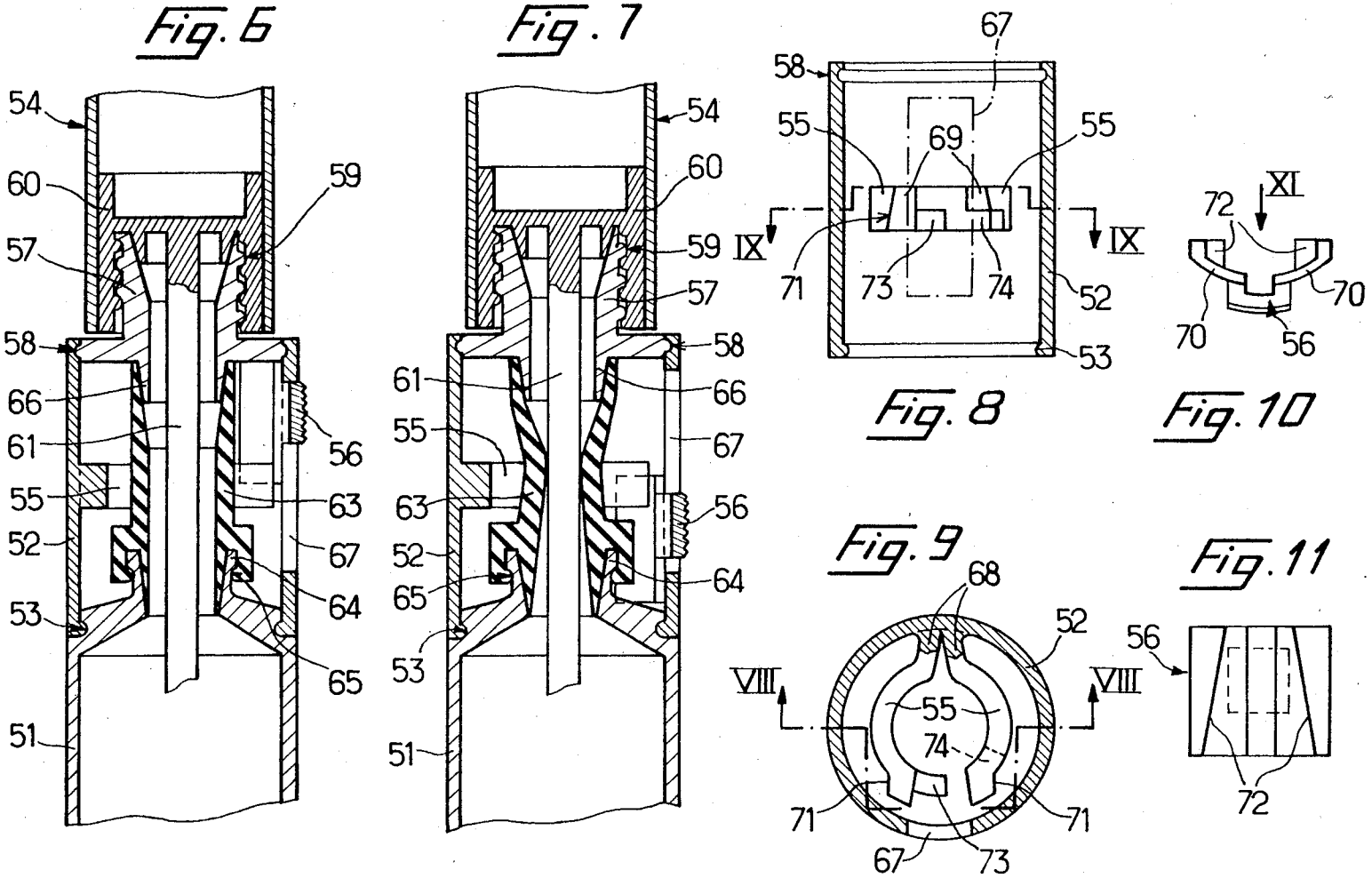
FIG. 6 is a longitudinal sectional view through a second mascara applicator according to the invention, in the position of minimum wiping dry.
FIG. 7 is a sectional view through the second applicator, in the position of maximum wiping dry.
FIG. 8 is a front view of the cylindrical member (52) of the second applicator of FIGS. 6 and 7.
FIG. 9 is a view along the line IX—IX of FIG. 8.
FIG. 10 is an underneath view of the slider (56) of the second applicator.
FIG. 11 is a front view of the slider (56).

FIG. 1 shows, in longitudinal section, the upper part of a mascara applicator according to the present invention. A container 1 containing the mascara carries a cylindrical member 2 fixed on it by a bead 3 which engages in a groove 4. This cylindrical member has a neck 5 defining the mouth of the mascara applicator and having an external screw thread 6 on to which a stopper 7 is screwed. The stopper 7 has an internal annular projection 8 having a tapering side which cooperates with the internal tapering wall of neck 5. It is moreover mounted in a cylindrical hood 10 permitting its manipulation.

The stopper 7 has a rod 9 provided at its free end with a brush (not shown), which is immersed in the mascara. When the stopper 7 is removed, the brush wipes against a vertical wiper, provided in the form of a sleeve 11 in resilient material. This sleeve 11 is secured by a bead/-groove arrangement 12 on to the container 1 inside of the cylindrical member 2. Its lower end 13 is centered by the neck 15 of the container 1, and its upper end 14 is centered by a annular projection 16 from the cylindrical member 2, which projection 16 is directed downwardly and surrounds the end 14. Thus, the assembly formed by the neck 15 of container 1, the sleeve 11 and the neck 5 of the cylindrical member 2 constitute an uninterrupted outlet conduit 17 for the brush.

The cylindrical member comprises in addition substantially vertical arms 18 mounted by their upper extremities in the upper portion of member 2 and in this way disposed around the periphery of sleeve 11. The number of arms may for example be sixteen. The arms 18 may be resiliently pliable, about their articulation mounting 26 in the top of member 2, such that their free ends 20 are brought into contact with sleeve 11. For this there is provided a sleeve 21 which is mounted around the arms 18.

Sleeve 21 has an internal screw thread which cooperates with an external screw thread 22 provided on the container 1, such that the sleeve 21 is vertically movable on the container 1. In its upper part the sleeve 21 has an inner surface 23 in the form of an upwardly open cone, such that it slides against the radially outer surface 25 of arms 18. Thus it has an internal space 24 peripherally of its upper end so as to enable it to be raised aboht arms 18.

In FIG. 1 the sleeve 21 is shown in its down position, where it just maintains the arms 18 inclined against the sleeve 11. In this position, the wiping of the brush on the free end of the rod 9 is at a minimum. In order that the sleeve 21 can be maneuvered with the fingers, two diametrically opposed windows 27 are provided in the side walls of the member 2. They are defined at top and bottom by a chamfer 31. The sleeve 21 has an upper extension 28 which ensures that the windows 27 are obstructed, whatever the vertical position of the sleeve.

FIG. 2 shows the mascara applicator of FIG. 1 in the position of maximum wiping dry. The sleeve 21 is screwed up completely against the arms 18, causing these to bear against the sleeve 11. This is thus restricted so as to ensure maximum wiping of the brush when it passes through the sleeve 11. The assembly of the ends 20 of the different arms 18 bearing against the sleeve 11 hold it positively such that the arms are not moved apart when the brush passes through sleeve 11 .

FIG. 3 is a longitudinal section through the member 2 of the applicator according to FIGS. 1 and 2. Here one can see more clearly its bead 3 for securing on the container, and a shoulder 32 for supporting of the member 2 on the container. Several arms 18 are shown. There are also shown the two windows 27 as well as the inner annular projection 16 for centering of the sleeve 11.

FIG. 4 is a section through the cylindrical member 2 along the lines IV–IV of FIG. 3. Sixteen arms 18 are shown, separated by the channels 19. The windows 27 of the member 2 are defined laterally by two plain faces 29.

FIG. 5 is a general view of the mascara applicator. Here there is shown the container 1, on which is mounted its cylindrical member 2 and stopper hood 10. Some graduations 30 are provided on the side edge of the windows 27 of the member 2 such as to permit the calibration of the vertical position of the sleeve 21, that is to say the degree of wiping dry of the brush.

FIG. 6 shows a second embodiment of the invention. A mascara container 51 is capped with a cylindrical member 52 which engages on it by means of a bead/-groove assembly 53. The cylindrical member 52 has in its middle part an articulated clip extending into its body and constituted by two horizontal arms 55 surrounding a central resilient sleeve 63. The two arms 55 are activated by a slider 56 sliding vertically as explained in more detail below and accessible from the outside through a window 67 provided in the cylindrical member 52.

A detachable neck 57 extending across the cylindrical member 52 is mounted in it by a bead/groove assembly 58. This neck 57, defining the mouth of the mascara applicator, has an outer screw thread 59 on which is screwed a stopper 60 in analogous fashion to that in FIG. 1. The stopper 60 is mounted in a cylindrical hood 54 and it is equipped with a rod 61 provided at its free end with a brush.

The resilient sleeve 63 is mounted inside the cylindrical member 52. It is secured to the outside of neck 64 of container 51 by a bead/groove assembly 65. This sleeve 63 is held in its middle part between the two arms 55 which surround it and at its other end by an annular part 66 mounted on neck 57, which extends into the sleeve 63.

In FIG. 6 the mascara applicator is shown in the position of minimum drying. The slider 56 is in the up position in the window 67.

In FIG. 7 the applicator is shown in the maximum drying position, the slider 56 being in the down position. The resilient sleeve 63 is restricted by the two arms 55 ensuring maximum wiping dry of the brush which is passed through it.

FIG. 8 shows a section of the cylindrical member 52 along the line VIII—VIII of FIG. 9. There is shown its lower securing bead 53 and the groove 58 for securing its neck. The front ends 69 of the two horizontal arms 55 can be seen and these front ends 69 each have an outer inclined surface 71. The end 69 shown on the left of the Figure has a lug 73 which cooperates with a housing 74 in the other end 69. There is represented in broken line the window 67 for the slider which window is provided in the wall of the cyindrical member 52.

FIG. 9 is a sectional view of the cylindrical member 52 along the line IX—IX of FIG. 8. There is shown the window 67 as well as the two arms 55, connected to the member 52 at their fixed ends 68 such that they may be pivoted by elastic deformation. The outer inclined surfaces 71 situated at the free ends of the two arms 55 are also visible.

FIG. 10 shows the slider 56 of FIGS. 6 and 7, seen from below. It comprises two arms 70 each provided at its free end with an inclined surface 72 intended to cooperate with the surface 71 of the arms 55 mounted in the cylindrical member 52.

FIG. 11 is a front view of the slider 56 shown in FIG. 10. The two inclined surfaces 72 are readily seen.

Figure 12:
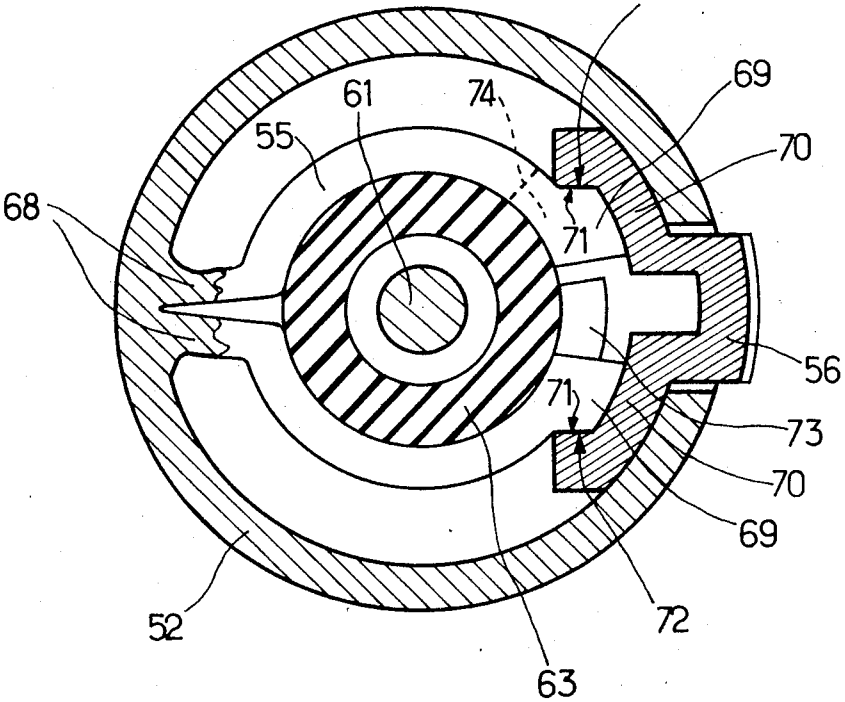
FIG. 12 is a transverse sectional view through the second applicator.

FIG. 12 is a transverse section through the mascara applicator of FIG. 6 taken at the level of the arms 55 in the cylindrical member 52. The arms 55 surround the sleeve 63, through which passes the rod 61 carrying the brush of the mascara applicator. The inclined surfaces 72 of the arms 70 of slider 56 engage the inclined surfaces 71 of the free ends 69 of arms 55 in cylindrical member 52. Thus the arms 55 are held together around resilient sleeve 63.

When the slider 56 is moved downwards the distance between the parts of inclined surfaces 72 engaging the free ends 69 of arms 55 is reduced. The free ends 69 are brought closer together, the arms 55 pivoting about their fixed ends 68. The arms 55 accordingly squeeze against the resilient sleeve 63. The sleeve 63 has its outer diameter, and in consequence its internal diameter, reduced. The drying of the brush effected when it is wiped against sleeve 63 as it is withdrawn through it is thus increased.

Figure 13:
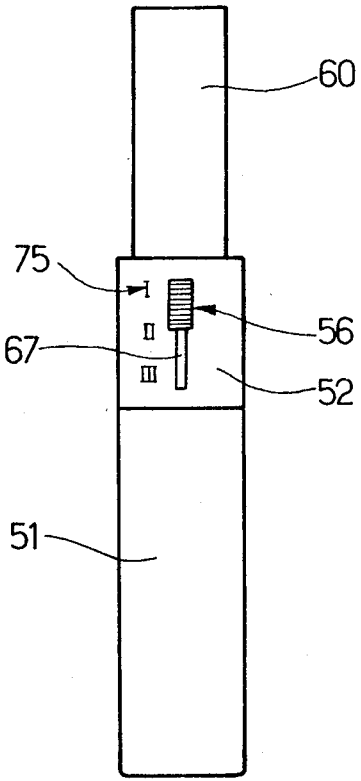
FIG. 13 is a general view of the second applicator.

FIG. 13 is a general view of the second mascara applicator according to the invention. The slider 56 substantially within cylindrical member 52 may be moved through the window 67. Some graduations 75 are provided at the edge of the window 67 to permit calibration of the different positions to the drying of the brush.

It is clear that other embodiments may be envisaged without departing from the spirit of the invention.

The preceding description of two possible embodiments of arrangement according to the present invention make apparent some further advantages. The wiping mechanism is situated outside the container and above it; the outer diameter of the container is accordingly reduced. Moreover, because of the important length of the wiper sleeve, the variation in diameter of the brush is very gradual between the position where it is wiped dry and the outlet neck of the applicator such that all risk of spattering by the brush is avoided. The wiping sleeve may preferably be made from synthetic rubber. Also the arrangement of the means for controlling the degree of wiping dry allow their easy access and clear visibility by the user to the exterior of the container and easy manipulation by means of a single finger.

This invention particularly finds its application in the manufacture of make-up articles, and most particularly of mascara applicators.

I claim:

1. In an adjustable applicator for fluid product comprising a reservoir for the fluid product, a stopper carrying application means which is immersed in the fluid product when the reservoir is closed by the stopper, and wiping means for said application means, which forms a rigid ring, the diameter of which is adjustable, said application means being passed through said rigid ring when it is withdrawn from said reservoir, the improvement comprising a flexible sleeve of uniform cross-section, which extends through said rigid ring and is supported at its two ends by said reservoir, said flexible sleeve being constricted between its two ends by said rigid ring in order to be urged against said application means and said constricted sleeve presenting to said application means a progressively decreasing inner section which progressively compresses said application means as said application means passes through said flexible sleeve.

2. An improved applicator according to claim 1, wherein said wiping means comprises a plurality of arms, distributed around the periphery of said flexible sleeve, substantially parallel to its axis, but being movable about an articulation, and a rigid sleeve surrounding said arms and urging their free ends against the periphery of said flexible sleeve, the transverse section of said flexible sleeve depending on the displacement of said rigid sleeve in its axial direction.

3. An improved applicator according to claim 2, wherein said arms are disposed in a slightly conical array and wherein said rigid sleeve has a corresponding tapering circular inner surface which cooperates with said arms.

4. An improved applicator according to claim 1, wherein said wiping means are constituted by two arms disposed about said flexible sleeve in a plane perpendicular to its axis, one or more of said arms being articulated at its fixed extremity, and by a slider permitting adjustment of separation of the free ends of said arms by its displacement in the axial direction with respect to said arms.

5. An improved applicator according to claim 4, wherein the surface of said two arms which are in contact with said slider are inclined with respect to the axis of said flexible sleeve, and wherein the surfaces of said slider which cooperate with said surfaces of said two arms are inclined in a complementary way.

* * * * *